US008646640B2

(12) United States Patent
Faris

(10) Patent No.: US 8,646,640 B2
(45) Date of Patent: Feb. 11, 2014

(54) COLLAPSIBLE CUP

(76) Inventor: David Faris, Hamden, CT (US)

( * ) Notice: Subject to any disclaimer, the term of this patent is extended or adjusted under 35 U.S.C. 154(b) by 0 days.

(21) Appl. No.: 13/596,352

(22) Filed: Aug. 28, 2012

(65) Prior Publication Data

US 2012/0318789 A1 Dec. 20, 2012

Related U.S. Application Data

(62) Division of application No. 12/481,005, filed on Jun. 9, 2009, now Pat. No. 8,267,271.

(51) Int. Cl.
*B65D 6/16* (2006.01)
*B65D 21/08* (2006.01)

(52) U.S. Cl.
CPC ..... *B65D 21/086* (2013.01); *B65D 21/08* (2013.01)
USPC ..... 220/8; 220/703

(58) Field of Classification Search
CPC ..... B65D 21/086; B65D 21/08; B65D 1/32
USPC ..... 220/8, 666, 288, 254.8, 254.1, 367.1, 220/714, 713, 711, 203.05, 203.04, 203.02, 220/203.19, 6, 4.01, 669, 703, 720; 215/314, 311, 307, 900; 206/218, 217; 229/405; 222/546, 545, 554, 563; D7/512, 509
IPC ..... B65D 6/16, 6/24, 8/14, 37/00, 8/04
See application file for complete search history.

(56) References Cited

U.S. PATENT DOCUMENTS

| | | | | |
|---|---|---|---|---|
| 1,037,068 | A * | 8/1912 | Smith | 220/8 |
| 1,040,652 | A * | 10/1912 | Douglas | 220/8 |
| 1,093,873 | A | 4/1914 | Mitchell | |
| 1,260,779 | A | 3/1918 | Koos | |
| 1,264,040 | A | 4/1918 | Fackler | |
| 1,337,524 | A * | 4/1920 | Levy | 126/215 |
| 1,344,716 | A * | 6/1920 | Powell | 220/8 |
| 1,482,425 | A * | 2/1924 | Ziony | 220/8 |
| 2,438,434 | A | 3/1948 | Friedman | |
| 2,880,902 | A | 4/1959 | Owsen | |
| 2,893,167 | A | 7/1959 | Davidson | |
| 3,132,763 | A | 5/1964 | Quiroz | |
| 3,237,802 | A | 3/1966 | Wagner | |
| 3,285,459 | A | 11/1966 | Gahm | |
| 3,471,058 | A | 10/1969 | Latham et al. | |
| 3,659,108 | A | 4/1972 | Quase | |

(Continued)

FOREIGN PATENT DOCUMENTS

| | | |
|---|---|---|
| EP | 1955954 | 8/2008 |
| JP | 10077043 | 3/1998 |

(Continued)

*Primary Examiner* — Robert J Hicks

(74) *Attorney, Agent, or Firm* — DeLio & Peterson, LLC; Thomas E. Ciesco

(57) ABSTRACT

A collapsible beverage container has a plurality of co-axially oriented, concentric cylindrical wall sections of progressively different diameters. The wall sections are extendable from a collapsed position wherein the wall sections substantially completely overlap in an axial direction to an extended position wherein the wall sections only partially overlap in an axial direction. The collapsible beverage container includes one or more elastomeric gaskets between adjacent cylindrical wall sections, each gasket providing a liquid-tight seal along the entire extension of the adjacent cylindrical wall sections between the extended and collapsed positions.

6 Claims, 6 Drawing Sheets

(56) References Cited

U.S. PATENT DOCUMENTS

| | | | |
|---|---|---|---|
| 4,190,173 | A | 2/1980 | Mason et al. |
| 5,211,289 | A | 5/1993 | Matthews |
| 5,294,014 | A | 3/1994 | Wyatt et al. |
| 5,384,138 | A | 1/1995 | Robbins, III et al. |
| 5,573,139 | A | 11/1996 | Yeh |
| 5,785,201 | A | 7/1998 | Bordner et al. |
| 5,862,932 | A | 1/1999 | Walsh et al. |
| 6,666,329 | B1 | 12/2003 | Charbonneau |
| 6,752,287 | B1 | 6/2004 | Lin |
| D544,303 | S | 6/2007 | Strepkoff |
| 7,491,139 | B2 | 2/2009 | Bridge et al. |
| 2005/0127074 | A1 | 6/2005 | Kusuma et al. |
| 2006/0169694 | A1 | 8/2006 | Kemper |
| 2009/0308867 | A1 * | 12/2009 | Lal ..... 220/8 |

FOREIGN PATENT DOCUMENTS

| | | |
|---|---|---|
| KR | 200230231 | 7/2001 |
| KR | 200308951 | 3/2003 |
| KR | 1020030046346 | 6/2003 |

* cited by examiner

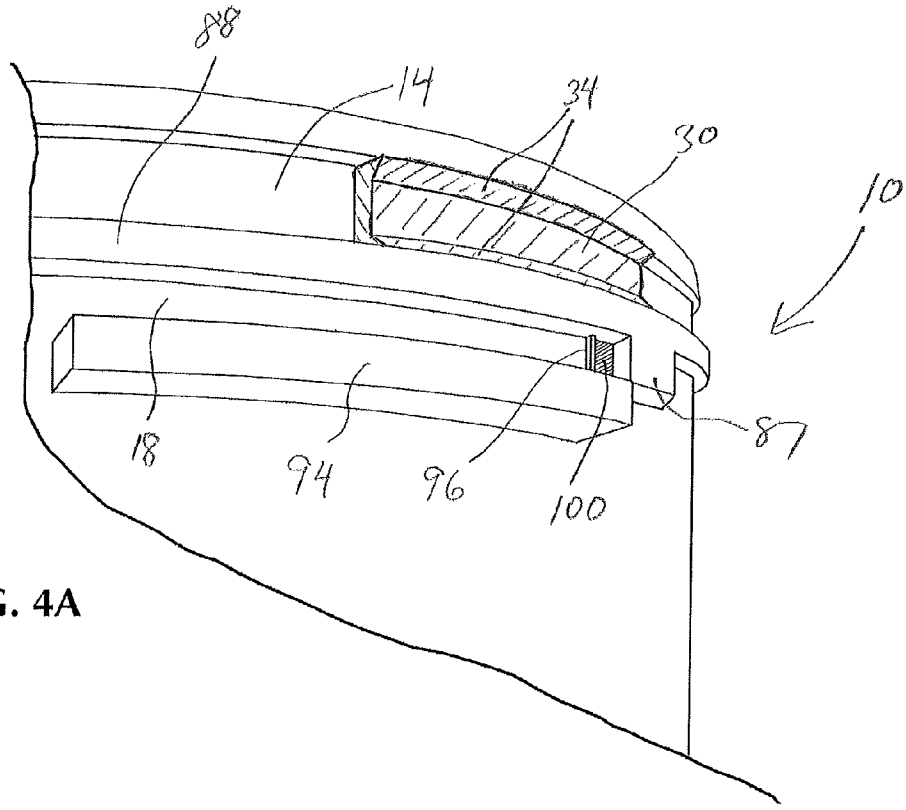
FIG. 4A
FIG. 4B
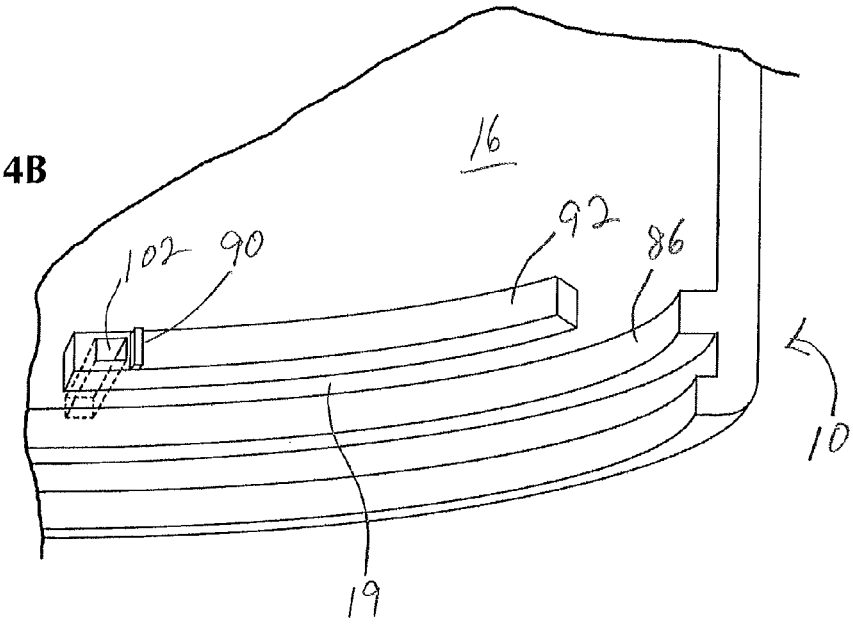

COLLAPSIBLE CUP

BACKGROUND OF THE INVENTION

1. Field of the Invention

The present invention relates to collapsible beverage containers which prevent liquids from leaking from between container sections.

2. Description of Related Art

Collapsible drinking cups have been used for decades with varying success in keeping the beverage contained within the cup. The cup allows for convenient storage and travel due to its ability to fit in a small space when in the collapsed position. The size and shape may vary, but such cups generally rely on a pressure fit between the container sections for preventing liquids from leaking out. The success of the pressure fit depends on the tolerance in the manufacture process, the ability to resist unwanted deformation such as dents and scratches, and the ability to resist deformation from pressures occurring while holding the beverage cup.

The inability of the prior art collapsible beverage cups to contain liquids effectively and consistently limits their use. Clothing is often a concern when using a collapsible cup, especially when a person is wearing formal or business wears. Spillage of some beverages creates a stain which, at best, is tough or expensive to remove, and at worst, permanently staining. Also, a person would not ordinarily use a collapsible cup on a desk where paperwork may be ruined, or in an auto where leakage would be a nuisance. More importantly, one would not even consider collapsing the prior art cups while a portion of the beverage was still in the cup, since they did not provide a liquid-tight seal in the collapsed position because of inadequate seals between the cup sections and in the lid. All of these problems are exacerbated by the inability of the cup to maintain itself in the extended position in the event that a minimal amount of pressure on the cup may in itself collapse the container. Prior art collapsible cups have other deficiencies that limit their usefulness and reliability.

SUMMARY OF THE INVENTION

Bearing in mind the problems and deficiencies of the prior art, it is therefore an object of the present invention to provide a collapsible beverage container which maintains a liquid-tight seal between sections when the container is in an extended position, a collapsed position, or any position therebetween.

It is another object of the present invention to provide a collapsible beverage container which includes a liquid-tight lid sealably attachable to the collapsible beverage container.

A further object of the invention is to provide a collapsible beverage container which includes a double seal for ensuring a liquid-tight seal between each container section.

It is yet another object of the present invention to provide a collapsible beverage container which includes a pressure relief valve for preventing accidents due to over pressurization.

It is still another object of the present invention to provide a collapsible beverage container which locks in an extended position.

A further object of the invention is to provide a means and method of locking a collapsible beverage container in an extended position.

Another object of the invention is to provide a means and method for assuring tactile, sound and/or visual confirmation that the cup is locked in an extended position.

Still other objects and advantages of the invention will in part be obvious and will in part be apparent from the specification.

The above and other objects, which will be apparent to those skilled in the art, are achieved in the present invention which is directed to a collapsible beverage container comprising a plurality of co-axially oriented, concentric cylindrical wall sections of progressively different diameters. The wall sections are extendable from a collapsed position wherein the wall sections substantially completely overlap in an axial direction to an extended position wherein the wall sections only partially overlap in an axial direction. The collapsible beverage container includes one or more elastomeric gaskets between adjacent cylindrical wall sections, each gasket providing a liquid-tight seal along the entire extension of the adjacent cylindrical wall sections between the extended and collapsed positions.

The elastomeric gasket may include at least two projecting lips and adjacent wall section may include a smooth inner surface. The projecting lips of the elastomeric gasket are sealingly slideable along the smooth inner surface of the adjacent wall section to provide the liquid-tight seal.

The collapsible beverage container may include a peripheral external groove at an upper end of at least one wall section and a smooth inner surface on an adjacent, larger diameter wall section. An elastomeric gasket is disposed in the groove and is sealingly slideable along the smooth inner surface of the adjacent wall section to provide the liquid-tight seal.

The collapsible beverage container may include a lid having an elastomeric gasket along a lid periphery, the lid being removably sealably attachable to a top end of the largest diameter cylindrical wall section to provide a liquid-tight seal at the top of the beverage container. The lid may include a pressure relief valve. The largest diameter cylindrical wall may have a smooth inner surface and an upper end periphery adapted to seal and lock with the lid.

The collapsible beverage container lid preferably includes a first opening adjacent an edge of the lid for drinking the beverage, a second opening in the central portion of the lid having internal threads, and a lid insert having external threads corresponding to the internal threads of the second opening. The lid insert has an outward extending flange whereby rotating the lid insert in one direction urges the flange against the first opening, sealing the opening in a closed position and rotating the lid insert in the opposite direction moves the flange away from the first opening to permit drinking the beverage.

Another aspect of the present invention is directed to a collapsible beverage container comprising a plurality of co-axially oriented, concentric cylindrical wall sections of progressively different diameters. The wall sections are extendable from a collapsed position wherein the wall sections substantially completely overlap in an axial direction to an extended position wherein the wall sections only partially overlap in an axial direction. The collapsible beverage container includes a lock for maintaining the wall sections in the extended position, the lock comprising a radially inwardly projecting lip at an end of one wall section extending around a portion of the periphery and a radially outwardly projecting lip at an end of an adjacent wall section extending around a portion of the periphery. The inwardly and outwardly projecting lips together extend around less than the full peripheries of the wall sections. The inwardly and outwardly projecting lips are adapted to axially pass each other upon extension of the wall sections and upon relative rotation of the wall sections to slideably connect and maintain relative axial position of the wall sections in the extended position.

The collapsible beverage container may include one or more elastomeric gaskets between adjacent cylindrical wall sections, each gasket providing a liquid-tight seal along the entire extension of the adjacent cylindrical wall sections between the extended and collapsed positions.

The collapsible beverage container may include a detent on one or both of the inwardly and outwardly projecting lips whereby the lips rotationally lock together upon extension and rotation of the wall sections. Alternately, a first detent is disposed on or adjacent the inwardly projecting lip and a second detent is disposed on or adjacent the outwardly projecting lip whereby the first and second detent lock together upon extension and rotation of the wall sections.

The collapsible beverage container may include a radially outwardly projecting stop extending along the full peripheries of each wall section. The container may include a radially inward projecting stop extending along the full peripheries of each wall section positioned near the inwardly projecting lip. The stops are adapted to prevent overextension of the wall sections.

Preferably, the collapsible container includes a lock groove between the outwardly projecting lip and the outwardly projecting stop, a first detent on the inwardly projecting lip and a second detent positioned in the groove whereby the first and second detent lock together upon extension and rotation of the wall sections. An indicator is positioned adjacent the second detent in the lock groove and is adapted to visually confirm the wall section locked with the adjacent wall section. A view aperture extends through the wall section on the inwardly projecting lip and is alignable with the indicator when the first and second detents are in the locked position. The visual locking indicator preferably has a color or texture different than the color or texture of the wall section. The indicator is preferably positioned between the outwardly projecting lip and the outwardly projecting stop.

Another aspect of the present invention is directed to a lid for a beverage container having a first opening adjacent an edge of the lid for drinking the beverage and a second opening in the central portion of the lid having internal threads. A lid insert includes external threads which correspond to the internal threads of the second opening. The lid insert includes an outward extending flange whereby rotating the lid insert in one direction urges the flange against the first opening, sealing the opening in a closed position and rotating the lid insert in the opposite direction moves the flange away from the first opening to permit drinking the beverage. A pressure relief valve may be disposed in the lid.

In another aspect, the present invention is directed to a method for using a collapsible beverage container. The method includes providing a collapsible beverage container having a plurality of co-axially oriented, concentric cylindrical wall sections of progressively different diameters, the wall sections being extendable from a collapsed position. The wall sections substantially completely overlap in an axial direction to an extended position and the wall sections only partially overlap in an axial direction. The cylindrical wall sections have a liquid-tight seal along the entire extension of the adjacent cylindrical wall sections between the extended and collapsed positions. The method includes ensuring the wall sections are in the extended position, providing a small portion of a beverage in the container, placing a lid on the container and urging the wall sections from the extended position to the collapsed position wherein the portion of the beverage remains sealed within the collapsed container.

The method preferably includes providing at least one elastomeric gasket between the adjacent cylindrical wall sections to provide the liquid-tight seal. The elastomeric gasket may include at least two projecting lips and include a smooth inner surface on an adjacent wall section. The projecting lips of the elastomeric gasket are sealingly slideable along the smooth inner surface of the adjacent wall section to provide the liquid-tight seal.

The method also preferably includes providing a peripheral external groove at an upper end of at least one wall section and a smooth inner surface on an adjacent, larger diameter wall section. The elastomeric gasket is disposed in the groove and is sealingly slideable along the smooth inner surface of the adjacent wall section to provide the liquid-tight seal.

In another aspect the present invention is directed to a method for using a collapsible beverage container comprising providing a collapsible beverage container having a plurality of co-axially oriented, concentric cylindrical wall sections of progressively different diameters, the wall sections being extendable from a collapsed position. The wall sections substantially completely overlap in an axial direction to an extended position wherein the wall sections only partially overlap in an axial direction. The method includes providing a lock for maintaining the wall sections in the extended position, the lock comprising a radially inwardly projecting lip at an end of one wall section extending around a portion of the periphery thereof and a radially outwardly projecting lip at an end of an adjacent wall section extending around a portion of the periphery. The inwardly and outwardly projecting lips together extend around less than the full peripheries of the wall sections. The inwardly and outwardly projecting lips are adapted to axially pass each other upon extension of the wall sections and, upon relative rotation of the wall sections, to slideably connect and maintain relative axial position of the wall sections in the extended position, the wall sections being in a collapsed position. The method includes urging the wall sections from the collapsed position to the extended position, rotating each wall section relative to the adjacent wall section to lock adjacent wall sections in the extended position; and dispensing a beverage into the beverage container.

The method may include providing a first detent on the inwardly projecting lip and a second detent on the outwardly projecting lip whereby the first and second detent lock together upon extension and rotation of the wall sections. The method includes rotating each wall section until the first and second detent lock together.

The method preferably includes providing an indicator adapted to visually confirm the wall section locked with the adjacent wall section the indicator having a color or texture different than the color or texture of the wall section and visually confirming each wall section is locked with the adjacent wall section after the step of rotating each wall section relative to the adjacent wall section.

The method may include providing a groove between the outwardly projecting lip and the outwardly projecting stop, a first detent on the inwardly projecting lip and a second detent positioned in the groove. The first and second detent lock together upon extension and rotation of the wall sections. The method includes providing an indicator positioned adjacent the second detent adapted to visually confirm the wall section locked with the adjacent wall section and a view aperture extending through the wall section on the inwardly projecting lip alignable with the indicator when first and second detents are in the locked position. The method includes confirming that the indicator is visible through the view aperture before dispensing the beverage.

In a further aspect, the present invention is directed to a method for using a lid for a beverage container. The method comprises providing a beverage container and a lid having a first opening adjacent an edge of the lid for drinking the beverage and a second opening in the central portion of the lid having internal threads. The lid insert has external threads corresponding to the internal threads of the second opening and the insert has an outward extending flange whereby rotating the lid insert in a first direction urges the flange against the first opening, sealing the first opening in a closed position. Rotating the lid insert in a second direction opposite the first direction moves the flange away from the first opening to permit drinking the beverage. The method includes providing a beverage in the beverage container, placing the lid on the beverage container and when drinking the beverage is desired, rotating the lid insert in the second direction to move the flange away from the first opening. The method may include rotating the lid insert in the first direction to seal the first opening. A pressure relief valve may be disposed on the lid.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 4A is a partial perspective view of the outwardly locking mechanism for the collapsible beverage container including a portion of the O-ring according to the present invention.

FIG. 4B is a perspective view of the inwardly locking mechanism for the collapsible beverage container according to the present invention.

DESCRIPTION OF THE PREFERRED EMBODIMENT(S)

In describing the preferred embodiment of the present invention, reference will be made herein to FIGS. 1A-7 of the drawings in which like numerals refer to like features of the invention.

Figure 1A:
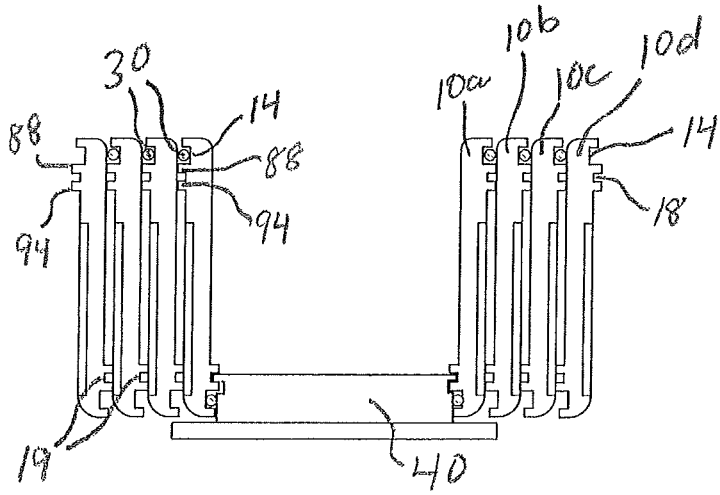
FIG. 1A is a cross sectional side view of the collapsible beverage container according to the present invention, in the collapsed position.
Figure 1B:
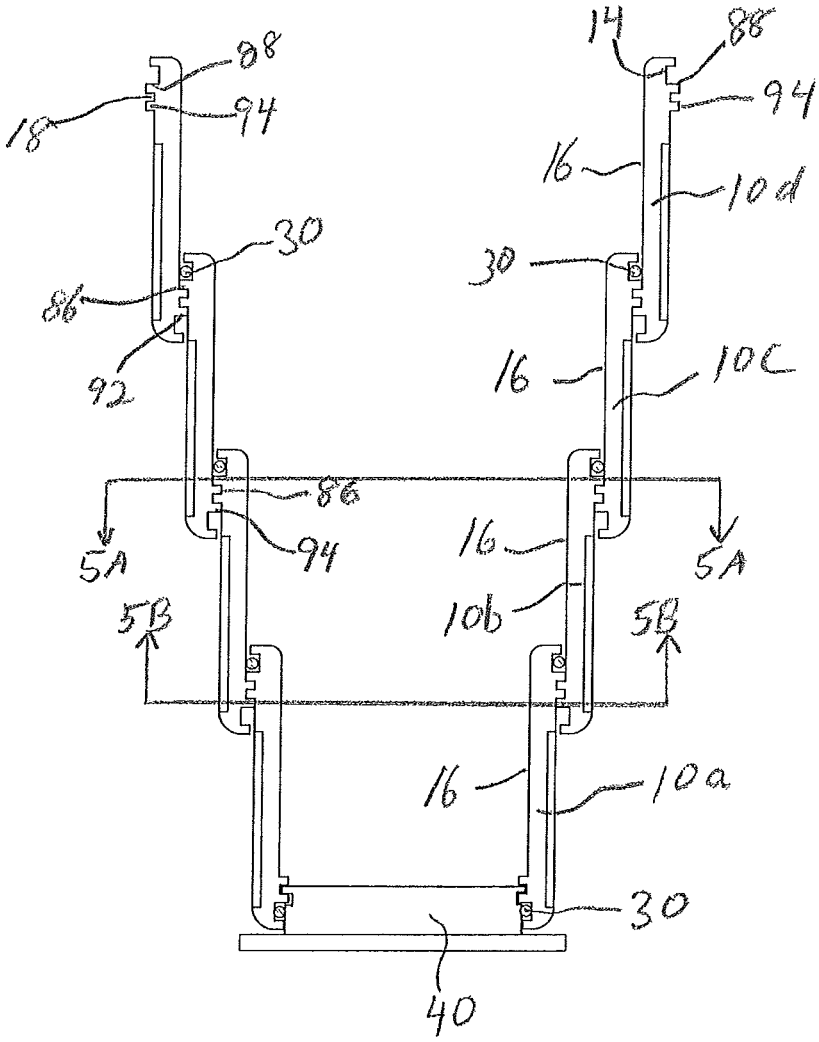
FIG. 1B is a cross sectional side view of the collapsible beverage container of FIG. 1A, in the extended position.
Figure 3:
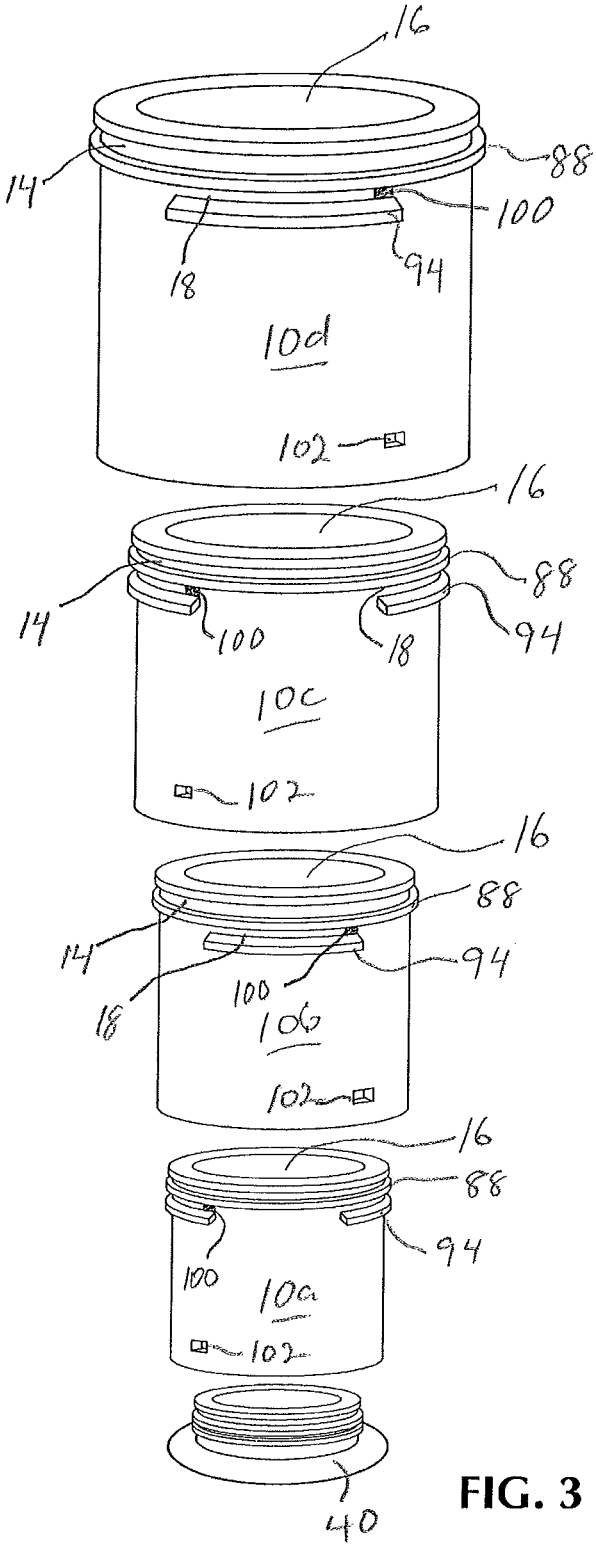
FIG. 3 is an exploded perspective view of the collapsible beverage container according to the present invention.
Figure 5A:
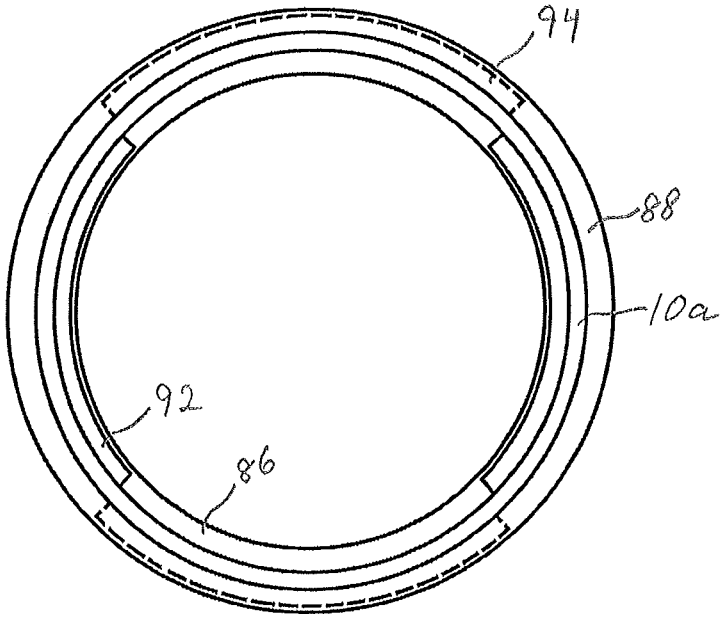
FIG. 5A is a top elevational view of the locking mechanism of the collapsible beverage container show in FIG. 1 by line 5A, according to the present invention.
Figure 5B:
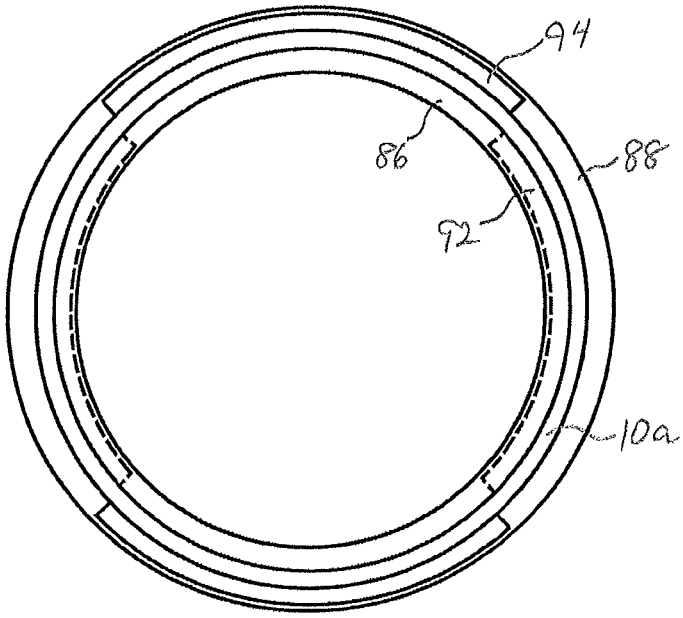
FIG. 5B is a bottom elevational view of the locking mechanism of the collapsible beverage container shown in FIG. 1 by line 5B, according to the present invention.

FIGS. 1A and 1B show a cross-sectional side view of the collapsible cup having a plurality of co-axially oriented, concentric cylindrical wall sections 10*a*-10*d* of progressively different diameters. FIG. 3 shows an exploded view of the collapsible beverage container including four wall sections 10*a*-10*d*, although the invention may include any number of wall sections. The wall sections are extendable from a collapsed position (FIG. 1A) for storage wherein the wall sections 10*a*-10*d* substantially completely overlap in an axial direction to an extended position (FIG. 1B) for use as a drinking vessel wherein the wall sections only partially overlap in an axial direction. An elastomeric gasket 30 is provided between each adjacent wall section. A base section 40 is sealingly attached to the lower wall section 10*a* and may be permanently attached or may include the gasket 30 so the base section may be removable from the wall section 10*a*. The base and wall sections are preferably injection molded from any suitable food-safe polymer.

Figure 2:
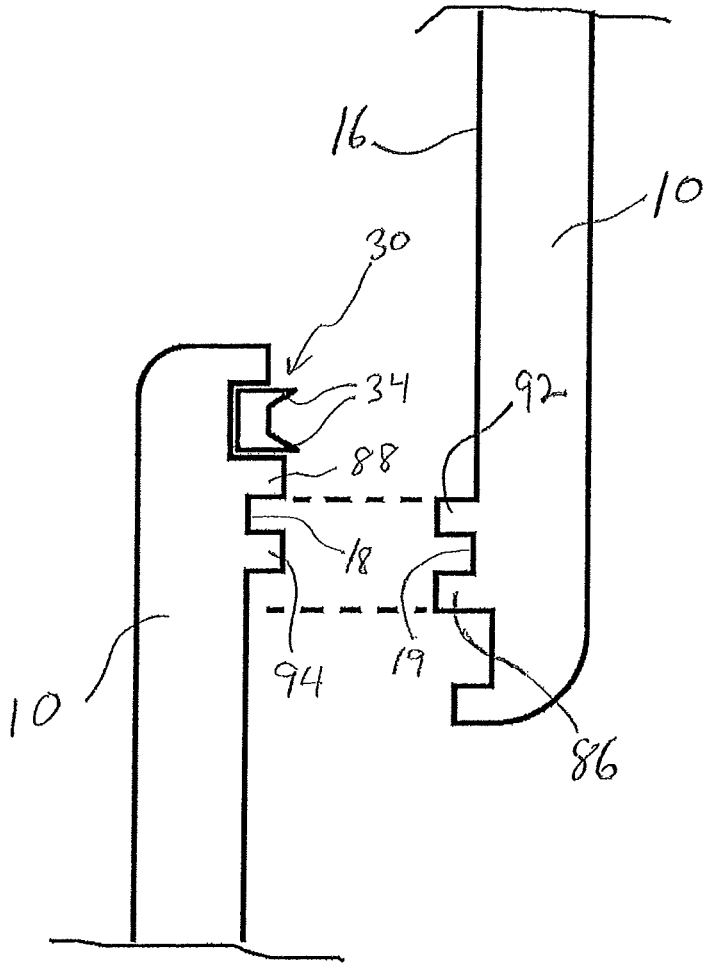
FIG. 2 is a cross-sectional view of a wall section with an O-ring in the external groove according to the present invention.

The elastomeric gaskets 30, shown in an enlarged cross-sectional view of a portion of the collapsible cup in FIG. 2, are disposed between adjacent cylindrical wall sections 10, each gasket 30 providing a liquid-tight seal along the entire extension of the adjacent cylindrical wall sections between the extended and collapsed positions. The preferred elastomeric gasket 30 is made of silicone and includes at least two outwardly projecting lips 34, which are sealingly slideable along the smooth inner surface 16 of the adjacent wall section to provide the liquid-tight seal.

The cylindrical wall sections 10*a*-10*d* each have a peripheral external groove 14 along the upper end of the wall section 10 and a smooth inner surface 16 on an adjacent, larger diameter wall section. An elastomeric gasket 30 shown in the wall section 10 of FIG. 2 is disposed in the groove 14 of each wall section and is sealingly slideable along the smooth inner surface 16 of the adjacent wall section to provide the liquid-tight seal. The gasket 30 may alternately be an O-ring having a single contact point along the wall section 10. The inner surface is smooth and straight allowing the gasket 30 to seal against the wall section when the collapsible beverage container 20 is in an extended position, collapsed position or any position therebetween.

Since the inner surface of each wall section is less likely to be damaged than the outer surface, the positioning of the gasket so that it slides against the inner surface of the adjacent wall section aids in maintaining long seal life. However, the elastomeric gasket 30 may be readily replaced in the event that it becomes damaged or otherwise loses its sealing ability.

In another embodiment, the collapsible cup includes the plurality of co-axially oriented, concentric cylindrical wall sections 10 of progressively different diameters as described in FIGS. 1A-3, but further includes locking means for preventing undesired accidental collapse of the wall sections. As shown in FIGS. 4A, 4B, 5A and 5B, a lock for maintaining the wall sections in the extended position includes a radially inwardly projecting lip or rim 92 at a lower end of the wall section 10 extending around a portion of the periphery thereof and a radially outwardly projecting lip or rim 94 at the upper end of an adjacent wall section extending around a portion of the periphery. Each of the projecting lips 92, 94 preferably describes an arc of slightly less than about 90° of the periphery. The inwardly and outwardly projecting lips 92, 94 together extend around less than the full 360° of the peripheries of the wall sections so that they may axially pass each other upon extension of the wall sections.

A first extension stop 86 is positioned below the radially inwardly projecting rim 92 to limit the wall section 10 from pulling off of the adjacent wall section during extension of the cup. A second extension stop 88 is positioned above the radially outwardly projecting rim 94 to limit the wall section 10 from pulling off of the adjacent wall section during extension of the cup.

A channel 18 is formed between locking rim 94 and extension stop 88, and includes a groove detent 96. A comparable channel 19 is formed between locking rim 92 and extension stop 86. When the beverage container is extended, the locking rim 92 of one wall section is above and proximate the locking rim 94 of an adjacent wall sections. Locking rim 92 is closely sized to slide into channel 18 while locking rim 94 is closely sized to slide into channel 19. Upon rotation of one wall section relative to the adjacent wall section, the locking rim 92 slides into position above the locking rim 94. The locking rim 92 includes a corresponding rim detent 90. In rotating a wall section about an adjacent wall section, when the beverage container is in the extended position, the rim and channel detents will contact each other and upon further urging, the detents will snap against one another, preventing accidental rotation in the opposite direction. The detent(s) may be positioned on one or both of the inwardly and outwardly projecting lips whereby the lips rotationally lock together upon extension and rotation of the wall sections.

Additionally, the locking mechanism may include an indicator 100 adapted to visually confirm the wall section is securely locked with the adjacent wall section. The indicator 100 is preferably a textured or colored portion of the wall section, preferably adjacent the detent 96, which aligns with viewing aperture 102 in the adjacent wall section when the wall sections are in the locked position. In the locked position, the indicator is then visible through the wall section aperture 102. A stop tab 87 positioned adjacent the indicator 100 and extending around a small portion of the wall section periphery prevents over-rotation of the wall section.

Figure 6:
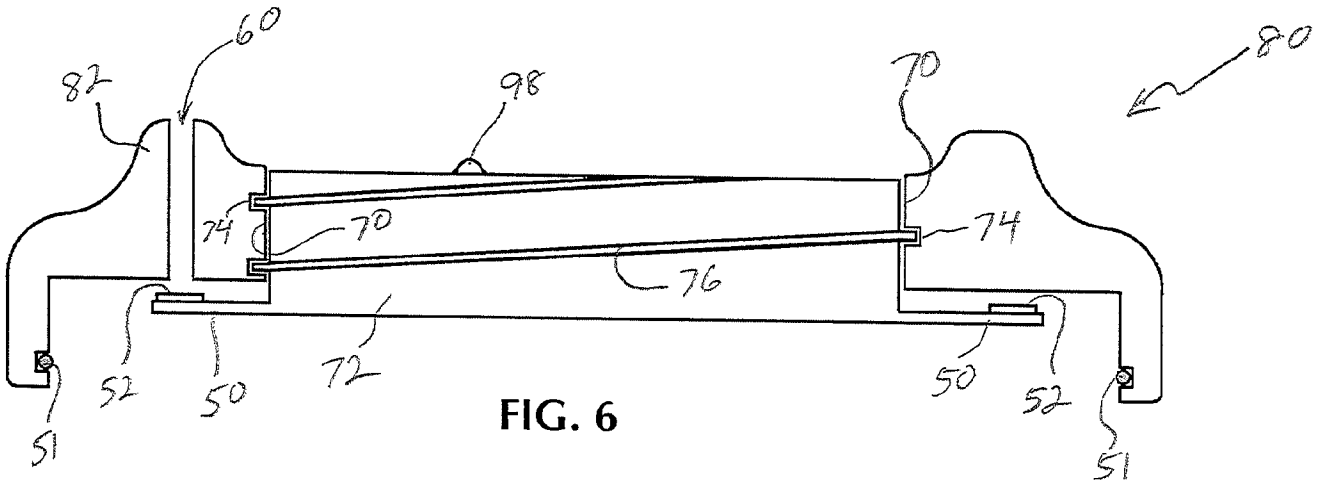
FIG. 6 is a cross-sectional side view of the lid for the collapsible beverage container in the open position according to the present invention.
Figure 7:
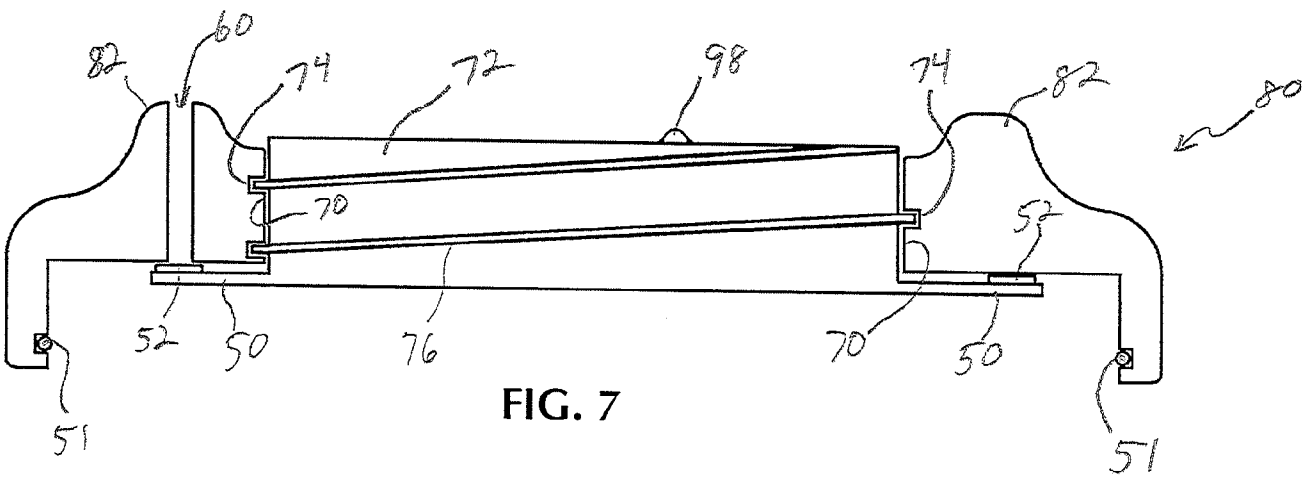
FIG. 7 is a cross-sectional side view of the lid for the collapsible beverage container in the closed position according to the present invention.

FIGS. 6 and 7 show a preferred lid 80 having opening 60 for allowing the user to draw the beverage through the opening. The lid includes an elastomeric gasket 51 along the lid periphery and is removably sealably attachable to a top end of the largest diameter cylindrical wall section 10*d* to provide a liquid-tight seal at the top of the beverage container. The largest diameter cylindrical wall 10*d* has a smooth inner surface 16 and an upper end periphery adapted to seal and lock with the lid.

Opening 60 for drinking the beverage is positioned adjacent an edge 82 of the lid 80 and extending through the lid. A central opening 70 in the central portion of the lid 80 includes internal threads 74 corresponding with external threads 76 on a lid insert 72. The lid insert includes an outward extending flange 50 and the elastomeric gasket or flange seal 52 on an upper portion of the flange. Rotating the lid insert in one direction urges the flange 50 against the first opening 60, sealing the opening in a closed position and preventing beverage from spilling from the first opening 60. Rotating the lid insert 72 in the opposite direction moves the flange away from the first opening to permit drinking of the beverage. A second opening for venting may be provided in a similar manner on the lid 180° opposite to drinking opening 60. The lid may also include a pressure relief valve 98 disposed in the lid.

The collapsed cup is normally stored as shown in FIG. 1A, with the wall sections 10*a*, 10*b*, 10*c* and 10*d* in essentially completely overlapped positions in the axial direction. In operation of the preferred embodiment as shown in FIGS. 1-7, the cup is grasped at the exterior outermost wall section 10*d* with one hand and at the base with the other hand, and the wall section 10*d* is urged away from the base 40 until the inwardly projecting locking rim 92 of each wall section contacts the outwardly extending extension stop 88 of the adjacent wall section, and outwardly projecting locking rim 94 of each wall section contacts the inwardly extending extension stop 86 of the adjacent wall section. As the cup expands, gaskets 30 at the top end of each wall section slide along the smooth inner surface of the next adjacent outer wall section to maintain a liquid-tight seal. The wall sections should be rotated relative to one another as necessary so that the locking rims pass by one another in the axial direction.

Once the locking rims make contact with extension stops, each inwardly projecting locking rim 92 is proximate to and above the outwardly projecting locking rim 94 of the adjacent wall section. Each wall section is rotated relative to the next adjacent wall section to cause the inwardly projecting rim 92 to slide into the aligned groove 18 and to cause outwardly projecting rim 94 to slide into aligned groove 19, until the rim detent 90 contacts the groove detent 96. Sufficient rotational pressure is then applied until the detents pass across each other, with a confirming tactile feel or click sound, thereby positioning the edge of inwardly projecting lip 92 against stop tab 87. Visual confirmation of proper lock alignment may be made by looking through the view aperture 102 and observing the indicator 100. The extension and rotation of the wall section and visual confirmation of proper lock operation is performed for each set of adjacent wall sections until the collapsible cup is in the fully extended and locked position.

Further use of the preferred embodiment includes placing a beverage in the beverage cup and placing the lid 80 on the top of the cup so that elastomeric gasket 51 along the lid periphery sealed to the top end of the largest diameter cylindrical wall section 10*d* to provide a liquid-tight seal at the top of the beverage container. For dispensing the beverage, a lid inset 72 is rotated in one direction to move a flange seal 52 down and away from a drinking opening 60, allowing the beverage to flow out through the opening into the user's mouth when the cup is sufficiently tipped.

Once little or no beverage remains, the cup may then be collapsed. The opening is then sealed by rotating the lid insert in the opposite direction until the gasket 52 moves upward and contacts and seals the drinking opening. Collapsing the cup includes rotating each wall section relative to the adjacent wall section until the inwardly and outwardly projecting rims slide from their respective grooves into clear position for axial movement and then urging the wall section toward the base 40. Because of the liquid-tight gasket seals between adjacent wall sections, any remaining beverage remains sealed inside the cup, and the collapsed cup may be safely placed inside a pocket, purse, briefcase or other location where it is important that no leakage occurs.

Thus, the present invention provides an improved collapsible beverage container which prevent liquids from leaking from between container sections when the container is in an extended position, collapsed position or any position therebetween. The invention further provides the ability for the sections to reliably lock in the extended position, which position is confirmed by a locking detent and visual indication. The present invention also provides an improved sealable lid for the collapsible beverage container.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A collapsible beverage container comprising:

a plurality of co-axially oriented, concentric cylindrical wall sections of progressively different diameters, the wall sections being extendable from a collapsed position wherein the wall sections substantially completely overlap in an axial direction to an extended position wherein the wall sections only partially overlap in an axial direction; and a lock for maintaining the wall sections in the extended position, the lock comprising a radially inwardly projecting lip at an end of one wall section extending around a portion of the periphery thereof and a radially outwardly projecting lip at an end of an adjacent wall section extending around a portion of the periphery thereof, the one wall section and the adjacent wall section are part of the plurality of cylindrical wall sections, the inwardly and outwardly projecting lips being adapted to axially pass each other upon extension of the wall sections and, upon relative rotation of the wall sections, to slideably connect and maintain relative axial position of the wall sections in the extended position;

a radially outwardly projecting stop extending along the peripheries of each wall sections, the stop adapted to prevent overextension of the wall section;

a groove between the outwardly projecting lip and the outwardly projecting stop;

a first detent on the inwardly projecting lip and a second detent positioned in the groove whereby the first and second detects lock together upon extension and rotation of the wall sections an indicator positioned adjacent the second detent adapted to visually confirm the wall section locked with the adjacent wall section; and a view aperture extending through the wall section on the inwardly projecting lip alignable with the indicator when first and second detents are in the locked position.

2. The collapsible beverage container of claim 1 the indicator has a color or texture different than the color or texture of the wall section.

3. A collapsible beverage container comprising:

a plurality of co-axially oriented, concentric cylindrical wall sections of progressively different diameters, the wall sections being extendable from a collapsed position wherein the wall sections substantially completely overlap in an axial direction to an extended position wherein the wall sections only partially overlap in an axial direction;

a lock for maintaining the wall sections in the extended position, the lock comprising a radially inwardly projecting lip at an end of one wall section extending around a portion of the periphery thereof and a radially outwardly projecting lip at an end of an adjacent wall section extending around a portion of the periphery thereof, the inwardly and outwardly projecting lips together extending around less than the full peripheries of the wall sections, the inwardly and outwardly projecting lips being adapted to axially pass each other upon extension of the wall sections and, upon relative rotation of the wall sections, to slideably connect and maintain relative axial position of the wall sections in the extended position; and one or more elastomeric gaskets between adjacent cylindrical wall sections, each gasket providing a liquid-tight seal along the entire extension of the adjacent cylindrical wall sections between the extended and collapsed positions.

4. A method for using a collapsible beverage container comprising:

providing a collapsible beverage container having a plurality of co-axially oriented, concentric cylindrical wall sections of progressively different diameters, the wall sections being extendable from a collapsed position wherein the wall sections substantially completely overlap in an axial direction to an extended position wherein the wall sections only partially overlap in an axial direction and a lock for maintaining the wall sections in the extended position, the lock comprising a radially inwardly projecting lip at an end of one wall section extending around a portion of the periphery thereof and a radially outwardly projecting lip at an end of an adjacent wall section extending around a portion of the periphery thereof, the one wall section and the adjacent wall section are part of the plurality of cylindrical wall sections, the inwardly and outwardly projecting lips being adapted to axially pass each other upon extension of the wall sections and, upon relative rotation of the wall sections, to slideably connect and maintain relative axial position of the wall sections in the extended position, the wall sections being in a collapsed position;

providing a groove between the outwardly projecting lip and the outwardly projecting stop;

providing a first detent on the inwardly projecting lip and a second detent positioned in the groove whereby the first and second detents lock together upon extension and rotation of the wall sections;

providing an indicator positioned adjacent the second detent adapted to visually confirm the wall section locked with the adjacent wall section;

providing a view aperture extending through the wall section on the inwardly projecting lip alignable with the indicator when first and second detents are in the locked position;

urging the wall sections from the collapsed position to the extended position; and rotating each wall section relative to the adjacent wall section to lock adjacent wall sections in the extended position; and confirming that the indicator is visible through the view aperture.

5. The method of claim 4 including providing a first detent on the inwardly projecting lip and a second detent on the outwardly projecting lip whereby the first and second detents lock together upon extension and rotation of the wall sections and wherein the step of rotating each wall section includes rotating the wall section until the first and second detents lock together.

6. The method of claim 4 wherein the indicator has a color or texture different than the color or texture of the wall section.

* * * * *